US005316629A

United States Patent [19]

Clifford et al.

[11] Patent Number: 5,316,629

[45] Date of Patent: May 31, 1994

[54] PROCESS FOR MAINTAINING ELECTROLYTE FLOW RATE THROUGH A MICROPOROUS DIAPHRAGM DURING ELECTROCHEMICAL PRODUCTION OF HYDROGEN PEROXIDE

[75] Inventors: Arthur L. Clifford, Everett, Derek J. Rogers; Dennis Dong, both of Kingston, all of Canada

[73] Assignee: H-D Tech Inc., Sarnia, Canada

[21] Appl. No.: 763,096

[22] Filed: Sep. 20, 1991

[51] Int. Cl.[5] ..... C25B 15/02

[52] U.S. Cl. ..... 204/83; 204/296

[58] Field of Search ..... 204/83, 84, 283, 296, 204/252; C25B 1/30

[56] References Cited

U.S. PATENT DOCUMENTS 4,431,494 2/1984 McIntyre et al. ..... 204/83

4,643,886 2/1987 Chang et al. ..... 204/129

4,872,957 10/1989 Dong et al. ..... 204/84

4,921,587 5/1990 Dong et al. ..... 204/84

5,074,975 12/1991 Oloman et al. ..... 204/83

FOREIGN PATENT DOCUMENTS 1214747 12/1986 Canada .

*Primary Examiner*—Kathryn Gorgos

*Attorney, Agent, or Firm*—Andrew E. Pierce

[57] ABSTRACT

A process is disclosed for maintaining or increasing electrolyte flow rate through a microporous diaphragm in an electrochemical cell for the production of hydrogen peroxide by maintaining in the electrolyte a sufficient concentration of a stabilizing agent. Flow rate is maintained or increased by complexing transition metal ions or compounds with the stabilizing agent.

8 Claims, No Drawings

PROCESS FOR MAINTAINING ELECTROLYTE FLOW RATE THROUGH A MICROPOROUS DIAPHRAGM DURING ELECTROCHEMICAL PRODUCTION OF HYDROGEN PEROXIDE

BACKGROUND OF THE INVENTION

1. Field of the Invention

This invention relates to the electrochemical production of alkaline hydrogen peroxide solutions.

2. Description of the Prior Art

The production of alkaline hydrogen peroxide by the electroreduction of oxygen in an alkaline solution is well known from U.S. Pat. No. 3,607,687 to Grangaard and U.S. Pat. No. 3,969,201 to Oloman et al.

Improved processes for the production of an alkaline hydrogen peroxide solution by electroreduction of oxygen are disclosed in U.S. Pat. No. 4,431,494 to McIntyre et al. and in Canadian 1,214,747 to Oloman. These patents describe methods for the electrochemical generation of an alkaline hydrogen peroxide solution designed to decrease the hydrogen peroxide decomposition rate in an aqueous alkaline solution (McIntyre et al.) and to increase the current efficiency (Oloman). In McIntyre et al., a stabilizing agent is utilized in an aqueous electrolyte solution in order to minimize the amount of peroxide decomposed during electrolysis, thus, maximizing the electrical efficiency of the cell, i.e., more peroxide is recovered per unit of energy expended. In Oloman, the continually decreasing current efficiency of electrochemical cells for the generation of alkaline peroxide by the electroreduction of oxygen in an alkaline solution is overcome by the inclusion of a complexing agent in the aqueous alkaline electrolyte which is utilized at a pH of 13 or more. Both McIntyre et al. and Oloman utilize chelating agents as the stabilizing agent or complexing agents, respectively. Both McIntyre et al. and Oloman disclose the use of alkali metal salts of ethylenediaminetetraacetic acid (EDTA) as useful stabilizing agents.

Electrochemical cells for the electroreduction of oxygen in an alkaline solution are disclosed in U.S. Pat. No. 4,872,957 and U.S. Pat. No. 4,921,587, both to Dong et al., and both incorporated herein by reference. In these patents, electrochemical cells are disclosed having a porous, self-draining, gas diffusion electrode and a microporous diaphragm. A dual purpose electrode assembly is disclosed in U.S. Pat. No. 4,921,587. The diaphragm can have a plurality of layers and may be a microporous polyolefin film or a composite thereof.

The present invention concerns a method for the electroreduction of oxygen in an alkaline solution in an electrochemical cell having a cell diaphragm or cell separator which is characterized as comprising a microporous film. Plugging of the pores of said film diaphragm during operation of the cell is avoided by the use of a stabilizing agent which can be a chelating agent.

SUMMARY OF THE INVENTION

The invention is a method for the electroreduction of oxygen in an alkaline solution in order to prepare an alkaline hydrogen peroxide solution. In the method of the invention, the electrolyte flow rate through the cell separator is maintained constant or increased during electroreduction by the incorporation of a stabilizing agent in the electrolyte used in said cell. It is believed that this prevents the deposition of insoluble compounds, present as impurities in said electrolyte, on or in the pores of the cell separator or diaphragm.

DETAILED DESCRIPTION OF THE INVENTION

It has been found, as disclosed in U.S. Pat. No. 4,431,494, that the efficiency of a process for the electrolytic production of hydrogen peroxide solutions utilizing an alkaline electrolyte can be improved by the incorporation of a stabilizing agent in the electrolyte solution. The amount of peroxide decomposed during electrolysis is thus minimized in accordance with the teaching of this patent. In the process of this patent, an electrolytic cell separator is disclosed as a permeable sheet of asbestos fibers or an ion exchange membrane sheet. Similarly, in Canadian Patent 1,214,747, the gradual reduction of current efficiency of an electrochemical cell for the electroreduction of oxygen in an alkaline solution has been found to gradually decrease over time so as to make the process uneconomic. The incorporation of a complexing agent which is preferably of the type which is effective to complex chromium, nickel, or particularly iron ions at a pH of at least 10 is utilized even though the pH of the alkaline electrolyte is at least about pH 13. The use of electrolytic cell separators or diaphragms consisting of a polypropylene felt is disclosed.

Neither of the cited references would suggest the use of stabilizing agents or complexing agents in an aqueous alkaline electrolyte solution for the electroreduction of oxygen in an alkaline solution to complex with or solubilize metal compounds or ions present in said electrolyte solution where a microporous polymer film is utilized as the cell separator or diaphragm. The fine pores of the diaphragm are subject to plugging during operation of the cell. This is because the asbestos diaphragm or polypropylene felt diaphragm disclosed, respectively, in the above references are not subject to plugging of the pores of the diaphragm in view of the fact that the porosity of these asbestos or polypropylene felt diaphragms is much greater than that of the microporous polymer film which is disclosed as useful in U.S. Pat. No. 4,872,957 and U.S. Pat. No. 4,921,587.

It has now been discovered that the presence of a stabilizing agent in an aqueous alkaline solution which is utilized as an electrolyte in an electrochemical cell for the electroreduction of oxygen allows the maintenance of a constant or increased flow rate of electrolyte through the cell separator or diaphragm where said diaphragm is composed of a microporous polymer film. The microporous polymer film diaphragm can be utilized in multiple layers in order to control the flow of electrolyte through the diaphragm. The use of multiple film layers allows substantially the same amount of electrolyte to pass to the cathode at various electrolyte head levels irrespective of the electrolyte head level to which the diaphragm is exposed. Uniformity of flow of electrolyte into a porous and self-draining electrode is important to achieve high cell efficiency.

To be suitable for use as a stabilizing agent, a compound must be chemically, thermally, and electrically stable to the conditions of the cell. Compounds that form chelates or complexes with the metallic impurities present in the electrolyte have been found to be particularly suitable. Representative chelating compounds include alkali metal salts of ethylene-diaminetraacetic acid (EDTA), alkali metal stannates, alkali metal phosphates, alkali metal heptonates, triethanolamine and 8-hydroxyquinoline. Most particularly preferred are salts of EDTA because of their availability, low cost and ease of handling.

The stabilizing agent should be present in an amount which is, generally, sufficient to complex with or solubilize at least a substantial proportion of the impurities present in the electrolye and, preferably, in an amount which is sufficient to inactivate substantially all of the impurities. The amount of stabilizing agent needed will differ with the amount of impurities present in a particular electrolyte solution. An insufficient amount of stabilizer will result in the deposition of substantial amounts of compounds or ions or in the pores of the microporous film diaphragm during operation of the cell. Conversely, excessive amounts of stabilizing agents are unnecessary and wasteful. The actual amount needed for a particular solution may be, generally, determined by monitoring the electrolyte flow rate as indicated by cell voltage during electrolysis, or, preferably, by chemically analyzing the impurity concentration in the electrolyte. Stabilizing agent concentrations of from about 0.05 to about 5 grams per liter of electrolyte solution have, generally, been found to be adequate for most applications.

Alkali metal compounds suitable for electrolysis in the improved electrolyte solution are those that are readily soluble in water and will not precipitate substantial amounts of $HO_2$—. Suitable compounds, generally, include alkali metal hydroxides and alkali metal carbonates such as sodium carbonate. Alkali metal hydroxides such as sodium hydroxide and potassium hydroxide are preferred because they are readily available and are easily dissolved in water.

The alkali metal compound, generally, should have a concentration in the solution of from about 0.1 to about 2.0 moles of alkali metal compound per liter of electrolyte solution (moles/liter). If the concentration is substantially below 0.1 mole/liter, the resistance of the electrolyte solution becomes too high and excessive electrical energy is consumed. Conversely, if the concentration is substantially above 2.0 moles/liter, the alkali metal compound peroxide ratio becomes too high and the product solution contains too much alkali metal compound and too little peroxide. When alkali metal hydroxides are used, concentrations from about 0.5 to about 2.0 moles/liter of alkali metal hydroxide are preferred.

Impurities which are catalytically active for the decomposition of peroxides are also present in the electrolyte solution. These substances are not normally added intentionally but are present only as impurities. They are usually dissolved in the electrolyte solution, however, some may be only suspended therein. They include compounds or ions of transition metals. These impurities commonly comprise iron, copper, and chromium. In addition, compounds or ions of lead can be present. As a general rule, the rate of flow of electrolyte decreases as the concentration of the catalytically active substances increases. However, when more than one of the above-listed ions are present, the effect of the mixture is frequently synergistic, i.e., the electrolyte flow rate when more than one type of ion is present is reduced more than occurs when the sum of the individual electrolyte flow rate decreasing ions present as compared to that flow rate which results when only one type of ion is present. The actual concentration of these impurities depends upon the purity of the components used to prepare the electrolyte solution and the types of materials the solution contacts during handling and storage. Generally, impurity concentrations of greater than 0.1 part per million will have a detrimental effect on the electrolyte flow rate.

The solution is prepared by blending an alkali metal compound and a stabilizing agent with an aqueous liquid. The alkali metal compound dissolves in the water, while the stabilizing agent either dissolves in the solution or is suspended therein. Optionally, the solution may be prepared by dissolving or suspending a stabilizing agent in a previously prepared aqueous alkali metal compound solution, or by dissolving an alkali metal compound in a previously prepared aqueous stabilizing agent solution. Optionally, the solutions may be prepared separately and blended together.

The prepared aqueous solution, generally, has a concentration of from about 0.01 to about 2.0 moles alkali metal compound per liter of solution and about 0.05 to about 5.0 grams of stabilizing agent per liter of solution. Other components may be present in the solution so long as they do not substantially interfere with the desired electrochemical reactions.

A preferred solution is prepared by dissolving about 40 grams of NaOH (1 mole NaOH) in about 1 liter of water. Next, 1.5 ml. of an aqueous 1.0 molar solution of the sodium salt of EDTA (an amino carboxylic acid chelating agent) is added to provide an EDTA concentration of 0.5 gram per liter of solution. The preferred solution is ready for use as an electrolyte in an electrochemical cell.

In addition to use of the preferred EDTA stabilizing agents above, it has been found that alkali metal phosphates, 8-hydroxyquinoline, triethanolamine (TEA), and alkali metal heptonates are useful stabilizing agents. The phosphates that are useful are exemplified by the alkali metal pyrophosphates. Representative preferred chelating agents are those which react with a polyvalent metal to form chelates such as the amino carboxylic acid, amino polycarboxylic acid, polyamino carboxylic acid, or polyamino polycarboxylic acid chelating agents. Preferred chelating agents are the amino carboxylic acids which form coordination complexes in which the polyvalent metal forms a chelate with an acid having the formula:

$$(A)_{3-n}\text{—}N\text{—}B_n$$

where n is two or three; A is a lower alkyl or hydroxyalkyl group; and B is a lower alkyl carboxylic acid group.

A second class for use in the process of preferred acids utilized in the preparation of chelating agents of the invention are the amino polycarboxylic acids represented by the formula:

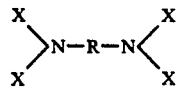

wherein two to four of the X groups are lower alkyl carboxylic groups, zero to two of the X groups are selected from the group consisting of lower alkyl groups, hydroxyalkyl groups, and

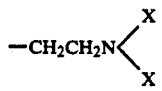

and wherein R is a divalent organic group. Representative divalent organic groups are ethylene, propylene, isopropylene or alternatively cyclohexane or benzene groups where the two hydrogen atoms replaced by nitrogen are in the one or two positions, and mixtures thereof.

Exemplary of the preferred amino carboxylic acids are the following: (1) amino acetic acids derived from ammonia or 2-hydroxyalkyl amines, such as glycine, diglycine (imino diacetic acid), NTA (nitrilo triacetic acid), 2-hydroxy alkyl glycine; di-hydroxyalkyl glycine, and hydroxyethyl or hydroxypropyl diglycine; (2) amino acetic acids derived from ethylene diamine, diethylene triamine, 1,2-propylene diamine, and 1,3-propylene diamine, such as EDTA (ethylene diamine tetraacetic acid), HEDTA (2-hydroxyethyl ethylenediamine tetraacetic acid), DETPA (diethylene triamine pentaacetic acid); and (3) amino acetic acids derived from cyclic 1,2-diamines, such as 1,2-diamino cyclohexane N,N-tetraacetic acid, and 1,2-phenylenediamine.

Suitable electrolytic cells are described in U.S. Pat. No. 4,921,587 and U.S. Pat. No. 4,872,957. Generally, such electrolytic cells for the production of an alkaline hydrogen peroxide solution have at least one electrode characterized as a gas diffusing, porous and self-draining electrode and a diaphragm which is, generally, characterized as a microporous polymer film.

The cell diaphragm, generally, comprises a microporous polymer film diaphragm and, preferably, comprises an assembly having a plurality of layers of a microporous polyolefin film diaphragm material or a composite comprising a support fabric resistant to degradation upon exposure to electrolyte and said microporous polyolefin film. Generally, the polymer film diaphragm can be formed of any polymer resistant to the cell electrolyte and reaction products formed therein. Accordingly, the cell diaphragm can be formed of a polyamide or polyester as well as a polyolefin. Multiple layers of said porous film or composite are utilized to provide even flow across the diaphragm irrespective of the electrolyte head level to which the diaphragm is exposed. No necessity exists for holding together the multiple layers of the diaphragm. At the peripheral portions thereof, as is conventional, or otherwise, the diaphragm is positioned within the electrolytic cell. Multiple diaphragm layers of from two to four layers have been found useful in reducing the variation in flow of electrolyte through the cell diaphragm over the usual and practical range of electrolyte head. Portions of the diaphragm which are exposed to the full head of electrolyte as compared with portions of the cell diaphragm which are exposed to little or no electrolyte head pass substantially the same amount of electrolyte to the porous, self-draining, gas diffusing cathode.

As an alternative means of producing a useful multiple layer vertical diaphragm, a cell diaphragm can be used having variable layers of the defined porous composite diaphragm material. Thus, it is suitable to utilize one to two layers of the defined porous composite material in areas of the cell diaphragm which are exposed to relatively low pressure (low electrolyte head pressure). This is the result of being positioned close to the surface of the body of electrolyte. Alternatively, it is suitable to use two to six layers of the defined composite porous material in areas of the diaphragm exposed to moderate or high pressure (high electrolyte head pressure). A preferred construction is two layers of the defined composite porous material at the top or upper end of the diaphragm and three layers of said composite at the bottom of said diaphragm.

For use in the preparation of hydrogen peroxide, a polypropylene woven or non-woven fabric support layer has been found acceptable for use in the formation of the composite diaphragms. Alternatively, there can be used as a support layer any polyolefin, polyamide, or polyester fabric or mixtures thereof, and each of these materials can be used in combination with asbestos in the preparation of the supporting fabric. Representative support fabrics include fabrics composed of polyethylene, polypropylene, polytetrafluoroethylene, fluorinated ethylenepropylene, polychlorotrifluorethylene, polyvinyl fluoride, asbestos, and polyvinylidene fluoride. A polypropylene support fabric is preferred. This fabric resists attack by strong acids and bases. The composite diaphragm is characterized as hydrophilic, having been treated with a wetting agent in the preparation thereof. In a 1 mil thickness, the film portion of the composite has a porosity of about 38% to about 45%, and an effective pore size of 0.02 to 0.04 micrometers. A typical composite diaphragm consists of a 1 mil thick microporous polyolefin film laminated to a non-woven polypropylene fabric with a total thickness of 5 mils. Such porous material composites are available under the trade designation CELGARD® from Celanese Corporation.

Utilizing multiple layers of the above described porous material as an electrolytic cell diaphragm, it is possible to obtain a flow rate within an electrolytic cell of about 0.01 to about 0.5 milliliters per minute per square inch of diaphragm, generally over a range of electrolyte head of about 0.5 foot to about 6 feet, preferably, about 1 to about 4 feet. Preferably, said flow rate over said range of electrolyte head, is about 0.03 to about 0.3 and most preferable is about 0.05 to about 0.1 milliliters per minute per square inch of diaphragm. Cells operating at above atmospheric pressure on the cathode side of the diaphragm would have reduced flow rates at the same anolyte head levels since it is the differential pressure that is responsible for electrolyte flow across the diaphragm.

Self-draining, packed bed, gas diffusing cathodes are disclosed in the prior art such as in U.S. Pat. No. 4,118,305; U.S. Pat. No. 3,969,201; U.S. Pat. No. 4,445,986; and U.S. Pat. No. 4,457,953 each of which are hereby incorporated by reference. The self-draining, packed bed cathode is typically composed of graphite particles; however, other forms of carbon can be used as well as certain metals. The packed bed cathode has a plurality of interconnecting passageways having average diameters sufficiently large so as to make the cathodes self-draining, that is, the effects of gravity are greater than the effects of capillary pressure on an electrolyte present within the passageways. The diameter actually required depends upon the surface tension, the viscosity, and other physical characteristics of the electrolyte present within the packed bed electrode. Generally, the passageways have a minimum diameter of about 30 to about 50 microns. The maximum diameter is not critical. The self-draining, packed bed cathode should not be so thick as to unduly increase the resistance losses of the cell. A suitable thickness for the packed bed cathode has been found to be about 0.03 inch to about 0.25 inch, preferably about 0.06 inch to about 0.2 inch. Generally, the self-draining, packed bed cathode is electrically conductive and prepared from such materials as graphite, steel, iron, and nickel. Glass, various plastics, and various ceramics can be used in admixture with conductive materials. The individual particles can be supported by a screen or other suitable support or the particles can be sintered or otherwise bonded together but none of these alternatives is necessary for the satisfactory operation of the packed bed cathode.

An improved material useful in the formation of the self-draining, packed bed cathode is disclosed in U.S. Pat. No. 4,457,953, incorporated herein by reference. The cathode comprises a particulate substrate which is at least partially coated with an admixture of a binder and an electrochemically active, electrically conductive catalyst. Typically, the substrate is formed of an electrically conductive or nonconductive material having a particular size smaller than about 0.3 millimeter to about 2.5 centimeters or more. The substrate need not be inert to the electrolyte or to the products of the electrolysis of the process in which the particle is used but is preferably chemically inert since the coating which is applied to the particle substrate need not totally cover the substrate particles for the purposes of rendering the particle useful as a component of a packed bed cathode. Typically, the coating on the particle substrate is a mixture of a binder and an electrochemically active, electrically conductive catalyst. Various examples of binder and catalyst are disclosed in U.S. Pat. No. 4,457,953.

In operation, the electrolyte solution described above is fed into the anode chamber of the electrolytic cell. At least a portion of it flows through the separator, into the self-draining, packed bed cathode, specifically, into passageways of the cathode. An oxygen-containing gas is fed through the gas chamber and into the cathode passageways where it meets the electrolyte. Electrical energy, supplied by the power supply, is passed between the electrodes at a level sufficient to cause the oxygen to be reduced to form hydrogen peroxide. In most applications, electrical energy is supplied at about 1.0 to about 2.0 volts at about 0.05 to about 0.5 amp per square inch. The peroxide solution is then removed from the cathode compartment through the outlet port.

The concentration of impurities which would ordinarily plug the pores of the microporous diaphragm during electrolysis is minimized during operation of the cell in accordance with the process of the invention. The impurities have been substantially chelated or complexed with the stabilizing agent and are rendered inactive. Thus, the cell operates in a more efficient manner.

The following examples illustrate the various aspects of the process of the invention but are not intended to limit its scope. Where not otherwise specified throughout this specification and claims, temperatures are given in degrees centigrade and parts, percentages, and proportions, are by weight.

EXAMPLE 1 (control, forming no part of this invention)

An electrolytic cell was constructed essentially as taught in U.S. Pat. Nos. 4,872,957 and 4,891,107, incorporated herein by reference. The cathode bed was double-sided, measuring 27" by 12" and two stainless steel anodes of similar dimensions were used. The cell diaphragm was Celgard 5511 arranged so that three layers were utilized for the bottom 26" of active area, and one layer was used for the top 1" of active area. The cell operated with an anolyte concentration of about one molar sodium hydroxide, containing about 1.5 weight % 41° Baume sodium silicate, at a temperature of about 20° C. The anolyte had a pH of 14. Oxygen gas was fed to the cathode chip bed at a rate of about 3.5 liter per minute. A current density of between about 0.34 and 0.52 amperes per square inch was maintained over a period of 67 days. All anolyte hydrostatic head values are given in inches of water column above the top of the cathode active area. Performance over this period is summarized in Table 1 below, and shows a steady deterioration of current efficiency with time.

TABLE 1

| | Cell Performance Characteristics Before Chelate Addition | | | | | |
|---|---|---|---|---|---|---|
| Day of Oper. | Curr. Dens. (Asi) | Cell Volt. (Vlts) | Prod. Flow Rate (ml/min) | Anolyte Head (Inches of water) | Product Weight Ratio ($NaOH/H_2O_2$) | Current Efficy. (%) |
| 1 | 0.48 | 2.08 | 68 | 42 | 1.64 | 89 |
| 5 | 0.45 | 2.15 | 57 | 24 | 1.57 | 85 |
| 20 | 0.40 | 2.24 | 60 | 38 | 1.72 | 86 |
| 40 | 0.40 | 2.31 | 58 | 44 | 1.77 | 77 |
| 55 | 0.34 | 2.40 | 39 | 28 | 1.77 | 74 |
| 64 | 0.41 | 2.33 | 56 | 46 | 1.92 | 73 |
| 67 | 0.41 | 2.32 | 55 | 46 | 1.94 | 71 |

EXAMPLE 2

On day 67, 0.02% by weight of EDTA was added to the anolyte of the cell of Example 1. The first analysis was performed seven hours later. On succeeding days, further EDTA was added to maintain approximately 0.02% by weight in the anolyte feed. The cell performance characteristics over a subsequent 5 day period are shown in Table 2.

TABLE 2

| | Cell Performance Characteristics After Chelate Addition | | | | | |
|---|---|---|---|---|---|---|
| Day of Oper. | Curr. Density (Asi) | Cell Volt. (Volts) | Prod. Flow Rate (ml/min) | Anolyte Head (Inches of water) | Prod. Wght. Ratio ($NaOH/H_2O_2$) | Curr. Efficy. (%) |
| 67 | 0.50 | 2.14 | 76 | 50 | 2.12 | 71 |
| 68 | 0.49 | 2.14 | 61 | 36 | 2.05 | 68 |
| 70 | 0.49 | 2.15 | 63 | 40 | 1.94 | 69 |
| 71 | 0.48 | 2.15 | 61 | 42 | 1.99 | 67 |

The addition of EDTA caused a sudden unexpected improvement in cell performance, notably in the reduced cell voltages and increased product flow rates at the same or lower anolyte heads. If the results are normalized to a similar current density, the improvement can be seen in the reduction in power required to produce one pound of hydrogen peroxide at the same ratio as follows:

TABLE 3

| Day of Oper. | Cell Voltage (volts) | Cell (normalized to 0.4 Asi) (volts) | Current Efficiency % | Power Consumpt. (KWH/lb) |
|---|---|---|---|---|
| 67 | 2.32 | 2.29 | 71 | 2.29 |
| 70 | 2.15 | 1.93 | 69 | 2.01 |

The results show a substantial lowering of cell voltage at a higher current after addition of 0.02 weight % EDTA to the anolyte. The product flow rate also increased initially and this was reduced by lowering of the anolyte hydraulic head. Most important, the power consumption has been reduced from 2.29 to 2.01 kilowatt-hours per pound of hydrogen peroxide. Without desiring to be bound by theory, it is thought that these observations were due to the chelate complexing of transition metal compounds or ions (impurities) that were deposited in the pores of the membrane and/or deposited directly on the composite cathode chips themselves. If insoluble impurities were deposited in the membrane pores, then some current paths would be blocked and the cell voltage would rise. On depositing transition metals on composite chips, it is expected that the hydrophobicity of the chips will decrease allowing a thicker film of liquid to build up. This in turn would impede oxygen diffusion to the active reduction sites, again resulting in an increase in cell voltage.

EXAMPLE 3

On completion of the test described in Example 2, the cell was shut down and the anolyte diluted with soft water and the pH adjusted with sulphuric acid to give a pH of 7. At this point, EDTA was added to give a 0.02 weight % solution, and the anolyte was allowed to recirculate through the cell overnight. The anolyte was made up to about one molar NaOH, and contained 1.5% added sodium silicate. On the following day, the cell was restarted. The cell was operated for a six day period, during which the performance characteristics were as shown in Table 4.

TABLE 4

| | Cell Performance Characteristics After Chelate Addition at pH 7 | | | | | |
|---|---|---|---|---|---|---|
| Day of Oper. | Curr. Density. (Asi) | Cell Volt. (volts) | Prod. Flow Rate (ml/min) | Anolyte Head (inches of water) | Prod. Wght. Ratio (NaOH/$H_2O_2$) | Curr. Efficy. (%) |
| 76 | 0.36 | 1.62 | 56 | 43 | 1.90 | 78 |
| 77 | 0.52 | 2.02 | 61 | 40 | 1.87 | 68 |
| 78 | 0.49 | 2.04 | 59 | 42 | 1.82 | 69 |
| 81 | 0.49 | 2.10 | 58 | 41 | 1.92 | 66 |

In Table 4, the further improvement in cell operation over the previous operation as shown in Example 2, Table 2, is seen in the further lowering of the cell voltage and the further reduction in the cell product ratio to an average of 1.88. Again, the improvement is seen more clearly if the cell voltage is normalized to 0.4 Asi and the power to produce one pound of hydrogen peroxide at the same or lower product ratio is compared to operation prior to EDTA treatment.

TABLE 5

| Day of Oper. | Cell Volt. (volts) | Cell Voltage (Normalized to 0.4 Asi) (volts) | Current Efficy. % | Power Consumpt. (KWH/lb) |
|---|---|---|---|---|
| 67 | 2.32 | 2.29 | 71 | 2.29 (Example 2) |
| 70 | 2.15 | 1.93 | 69 | 2.01 |
| 78 | 2.04 | 1.81 | 69 | 1.88 (Example 3) |

In Table 5, it can be seen that consecutive treatment of the alkaline peroxide cell with the chelate has improved the power consumption to 1.88 kilowatt-hours per pound of hydrogen peroxide. The action of EDTA may be more effective at the lower, neutral pH than at the higher pH (13.5 to 14.2) at which the cell is normally operated. This is because metal ions, particularly iron ions, can undergo hydrolysis at higher pH values, precipitating metal hydroxide which would impede flow (of fluid and current) through the membrane.

EXAMPLE 4

In a commercially operating plant for the production of hydrogen peroxide, said plant electrochemical cells having microporous cell membranes, the failure of the water softening apparatus resulted in the supply water becoming approximately 120 parts per million in hardness (expressed as calcium carbonate) for several hours. The normal process water contains less than 2 parts per million of hardness on the same basis. Subsequent to this hardness excursion, the cell voltages were observed to rise by approximately 100 millivolts. Cell voltages during this period of hardness excursion are shown in Table 6 below.

During subsequent operation of the plant, a solution of ethylene diamine tetracetic acid (EDTA) was added to the cell anolyte at a rate so as to maintain a concentration of 0.02% by weight over a period of 3.5 hours. Over this period, the cell voltages fell, as indicated by comparison of the values shown in Table 7 below with those shown in Table 6. It is postulated that increased liquid flow through the membrane which occurs subsequent to treatment with EDTA results in reduced voltages at comparable currents.

TABLE 6

| CELL PERFORMANCE AFTER HARDNESS EXCURSION | | | | | | | |
|---|---|---|---|---|---|---|---|
| CELL # | VOLT | CELL # | VOLT | CELL # | VOLT | CELL # | VOLT |
| 1 | 1.869 | 13 | 1.709 | 25 | 1.977 | 37 | 1.806 |
| 2 | 1.827 | 14 | 1.698 | 26 | 2.036 | 38 | 1.736 |
| 3 | 1.739 | 15 | 1.670 | 27 | 1.836 | 39 | 1.664 |
| 4 | 1.908 | 16 | 1.741 | 28 | 1.670 | 40 | 1.752 |
| 5 | 1.700 | 17 | 1.641 | 29 | 1.698 | 41 | 1.670 |
| 6 | 1.920 | 18 | 1.792 | 30 | 1.789 | 42 | 1.756 |
| 7 | 1.778 | 19 | 1.778 | 31 | 1.850 | 43 | 1.753 |
| 8 | 1.747 | 20 | 1.786 | 32 | 1.717 | 44 | 1.787 |
| 9 | 1.677 | 21 | 1.700 | 33 | 1.895 | 45 | 1.870 |
| 10 | 1.773 | 22 | 1.844 | 34 | 1.733 | 46 | 1.731 |
| 11 | 1.833 | 23 | 1.938 | 35 | 1.748 | 47 | 1.839 |
| 12 | 1.778 | 24 | 1.625 | 36 | 1.775 | 48 | 1.752 |

TABLE 7

| CELL PERFORMANCE AFTER EDTA TREATMENT | | | | | | | |
|---|---|---|---|---|---|---|---|
| CELL # | VOLT | CELL # | VOLT | CELL # | VOLT | CELL # | VOLT |
| 1 | 1.817 | 13 | 1.645 | 25 | 1.931 | 37 | 1.742 |
| 2 | 1.772 | 14 | 1.650 | 26 | 2.003 | 38 | 1.675 |
| 3 | 1.669 | 15 | 1.606 | 27 | 1.797 | 39 | 1.610 |
| 4 | 1.844 | 16 | 1.681 | 28 | 1.616 | 40 | 1.694 |
| 5 | 1.641 | 17 | 1.572 | 29 | 1.661 | 41 | 1.614 |
| 6 | 1.856 | 18 | 1.727 | 30 | 1.731 | 42 | 1.692 |
| 7 | 1.712 | 19 | 1.722 | 31 | 1.811 | 43 | 1.692 |
| 8 | 1.734 | 20 | 1.725 | 32 | 1.659 | 44 | 1.725 |
| 9 | 1.614 | 21 | 1.637 | 33 | 1.848 | 45 | 1.803 |
| 10 | 1.722 | 22 | 1.800 | 34 | 1.722 | 46 | 1.661 |
| 11 | 1.783 | 23 | 1.883 | 35 | 1.681 | 47 | 1.781 |
| 12 | 1.727 | 24 | 1.548 | 36 | 1.720 | 48 | 1.684 |

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A method of maintaining constant or increasing electrolyte flow rate through the pores of a microporous polymer film cell separator or diaphragm during the operation of an electrochemical cell for the production of an alkaline hydrogen peroxide solution comprising:

A) maintaining a concentration of a stabilizing agent in said electrolyte sufficient to complex with or solubilize a substantial proportion of the transition metal compounds or ions, or other metal compounds or ions present as impurities in said electrolyte and B) periodically shutting down said cell, lowering the pH of said electrolyte to about 7, and recirculating said electrolyte containing a concentration of a stabilizing agent sufficient to complex with or solubilize a substantial portion of the transition metal compounds or ions, or other metal compounds or ions present as impurities in said electrolyte.

2. The method of claim 1 wherein said stabilizing agent is a chelating agent which is the reaction product of a metal and an acid selected from the group consisting of an a polyamino carboxylic acid, an amino polycarboxylic acid, and a polyamino polycarboxylic acid.

3. The method of claim 1 wherein said stabilizing agent is selected from the group consisting of an alkali metal salt of ethylene/diamine tetraacetic acid (EDTA), an alkali metal salt of diethylene triamine pentacetic acid (DTPA), alkali metal stannates, alkali metal phosphates, 8-hydroxyquinoline, triethanolamine (TEA) and alkali metal heptonates.

4. The method of claim 3 wherein said electrochemical cell comprises a porous, substantially uniform, electrolyte flow rate producing, microporous polypropylene film diaphragm.

5. A method of maintaining constant or increasing electrolyte flow rate through the pores of a microporous polymer film cell separator or diaphragm during the operation of an electrochemical cell for the production of an alkaline hydrogen peroxide solution comprising:

A) periodically shutting down said cell, lowering the pH to about 7, and recirculating said electrolyte containing a concentration of a stabilizing agent sufficient to complex with or solubilize a substantial proportion of the transition metal compounds or ions, or other metal compounds or ions present as impurities in said electrolyte and B) restarting the operation of said cell.

6. The method of claim 5 wherein said stabilizing agent is a chelating agent which is the reaction product of a metal and an acid selected from the group consisting of an amino carboxylic acid, an amino polycarboxylic acid, and a polyamino polycarboxylic acid.

7. The method of claim 6 wherein said stabilizing agent is selected from the group consisting of an alkali metal salt of ethylene/diamine tetraacetic acid (EDTA), an alkali metal salt of diethylene triamine pentacetic acid (DPTA), alkali metal stannates, alkali metal phosphates, 8-hydroxyquinoline, triethanolamine (TEA) and alkali metal heptonates.

8. The method of claim 7 wherein said electrochemical cell comprises a porous, substantially uniform, electrolyte flow rate producing, microporous polypropylene film diaphragm.

* * * * *